US007753217B2

(12) United States Patent
Lawson

(10) Patent No.: US 7,753,217 B2
(45) Date of Patent: Jul. 13, 2010

(54) HANGER FOR USE WITH A SLATWALL TRACK AND A RETAINER THEREFOR

(76) Inventor: Stephen Lawson, 1947 Ocean Park Road, Surrey, B.C. (CA) V4A 3M2

( * ) Notice: Subject to any disclaimer, the term of this patent is extended or adjusted under 35 U.S.C. 154(b) by 179 days.

(21) Appl. No.: 12/005,090

(22) Filed: Dec. 26, 2007

(65) Prior Publication Data

US 2008/0105637 A1 May 8, 2008

(51) Int. Cl.
*A47F 5/08* (2006.01)

(52) U.S. Cl. ..... 211/94.01

(58) Field of Classification Search ..... 211/57.1, 211/59.1, 94.01; 248/220.21, 222.52, 304, 248/339

See application file for complete search history.

(56) References Cited

U.S. PATENT DOCUMENTS

| | | | | | |
|---|---|---|---|---|---|
| 2,665,869 | A * | 1/1954 | Samuels | 248/214 |
| 3,452,954 | A * | 7/1969 | Lucietto et al. | 248/220.22 |
| 4,303,217 | A * | 12/1981 | Garfinkle | 248/220.42 |
| 4,512,481 | A * | 4/1985 | Thalenfeld | 211/57.1 |
| 4,615,448 | A | 10/1986 | Johnstonbaugh | |
| 4,678,151 | A * | 7/1987 | Radek | 248/223.41 |
| 4,726,554 | A * | 2/1988 | Sorrell | 248/222.51 |
| 5,348,167 | A * | 9/1994 | Jensen | 211/57.1 |
| 6,119,878 | A * | 9/2000 | Zen | 211/94.01 |
| 6,378,828 | B1 * | 4/2002 | Valiulis et al. | 248/231.81 |
| 6,631,813 | B1 | 10/2003 | Walter et al. | |
| 6,722,619 | B2 * | 4/2004 | Valiulis et al. | 248/220.31 |
| 6,811,043 | B2 * | 11/2004 | Perkins et al. | 211/94.01 |
| 6,971,614 | B2 * | 12/2005 | Fischer et al. | 248/220.43 |
| 7,175,149 | B2 | 2/2007 | Gallien | |
| 7,228,977 | B2 * | 6/2007 | Perkins et al. | 211/94.01 |
| 2007/0256996 | A1 * | 11/2007 | Jackle | 211/94.01 |
| 2008/0047910 | A1 * | 2/2008 | Kubota | 211/59.1 |

* cited by examiner

*Primary Examiner*—Janet M Wilkens
*Assistant Examiner*—Dan Rohrhoff
(74) *Attorney, Agent, or Firm*—Frederick Kaufman, Inc.

(57) ABSTRACT

A retainer is shaped and sized to accommodate within it a bracket of a hanger in order to prevent an upward, vertical translation of the bracket, followed by its pivoting and finally fall to the ground, by using one end of the retainer for positioning and stabilizing, with respect to one channel of a slatwall track, one extremity of the bracket, while another end of the retainer, vertically spaced from the aforementioned one, is inserted by snapping into another parallel channel of the slatwall track.

1 Claim, 5 Drawing Sheets

HANGER FOR USE WITH A SLATWALL TRACK AND A RETAINER THEREFOR

I. BACKGROUND OF THE INVENTION

1. Definition of the Invention

The present invention refers, in general, to features for preventing a dislodging of hangers attached to slatwall tracks and, more particularly, to a hanger for use with a slatwall track and a retainer therefor.

2. Description of the State of Art

The walls of a building in residential, commercial and industrial buildings are frequently provided with one or more slatwall tracks used in combination with hangers to display a variety of objects off the floor of the building. The objects can be similar, such as in a display for merchandise in retail stores, for example shoes, or they can vary in shape, size, such as hand tools and alike suspended in garages or workshops.

The hangers can also be used to support shelves for storing or displaying various items. Slatwall tracks are generally secured to a building structure, which includes without limitation any walls, such as temporary or permanent walls. The walls may or may not be covered with wallboard. The slatwall tracks are attached with screws directly to walls having physical strength, to an existing frame or studs normally used to hold the wallboard.

Often a slatwall track is interlockingly connected with an identical upper and/or lower slatwall track(s). Also, two or more usually like-shaped slatwall tracks are mounted vertically spaced and horizontally aligned and parallel. A single slatwall track, mounted alone, is also used.

Usually, several hangers or other supporting devices are attached

A main disadvantage of hangers secured to slatwall tracks resides in the fact that the attachment of the former to the latter is unreliable. Hangers can be dislodged following an unintentionally caused vertical push that forces the hangers' brackets to move vertically until they cease their engagement with slatwall tracks and, then, turn around and fall to the ground. The people around can be injured and the hung items can be damaged. When loaded hangers are positionally displaced, dislodging can also occur.

Attempts have been made to solve the dislodging problem. For example, U.S. Pat. No. 6,971,614 granted on Dec. 6, 2005 to Fischer et al. for a "SLATWALL HANGER STABILIZING CLIP" discloses a slatwall assembly including several interlocked tracks. Each of the tracks has an upper and lower end provided with a lip with an inside surface, so that adjacent tracks form a channel with a narrow outer portion and a wider inner portion. A hanger comprises an upper end that is inserted into an upper channel, and a lower end that hangs near a lower adjacent channel. A stabilizing clip has a main body and an extending brace. The body is sized and shaped to firmly snap fit into the lower channel. The brace extends upwardly along a middle track to form a channel for receiving the lower end of the hanger and retaining it against the surface of a middle track. The main shortcoming of the foregoing stabilizing clip resides in the fact that it does not prevent completely an upward inadvertently caused movement of the hanger, although it retains the lower end of the hanger against pivoting around the upper end.

II. SUMMARY OF THE INVENTION

Based on the above description, one can conclude that there is a need for an improved retainer. Thus, a first objective of the present invention is to develop a simple and secure retainer able to prevent the hanger against dislodging caused by an inadvertent hit.

A second objective of the present invention is to develop a retainer easy to insert into or remove from its working position.

A third objective of the present invention is to provide a retainer which is ergonomically efficient and has an esthetically appealing appearance.

Broadly stating, according to the present invention a retainer is shaped and sized to accommodate within it a bracket of a hanger in order to prevent an upward, vertical translation of the bracket, followed by its pivoting and finally fall to ground, by:

using one end of the retainer for positioning and stabilizing, with respect to one channel of a slatwall track, one extremity of the bracket, while another end of the retainer, vertically spaced from the aforementioned one, is inserted by snapping into another parallel channel of the slatwall track.

III. BRIEF DESCRIPTION OF THE DRAWINGS

Although the characteristic features of the invention will be particularly pointed out in the claims, the invention itself and the manner in which it may be made and used may be better understood by referring to the following description and accompanying drawings, where like reference numerals refer to like parts throughout the several views of the drawings, in which:

IV. DESCRIPTION OF THE PREFERRED EMBODIMENTS

Figure 1:
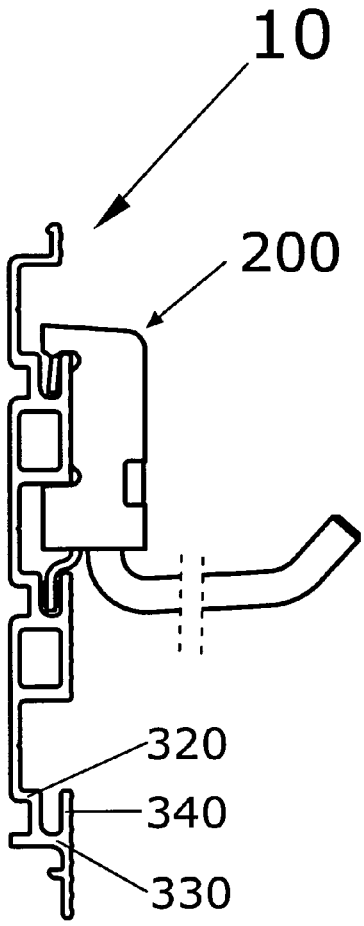
FIG. 1 is a side elevation view of the present invention.
Figure 2:
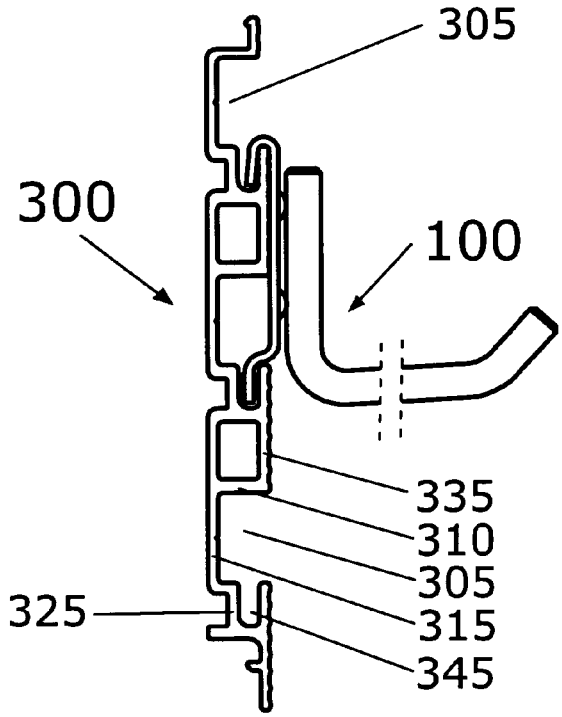
FIG. 2 is a side elevation view of the present invention, as depicted in FIG. 1, wherein the retainer is removed.
Figure 3:
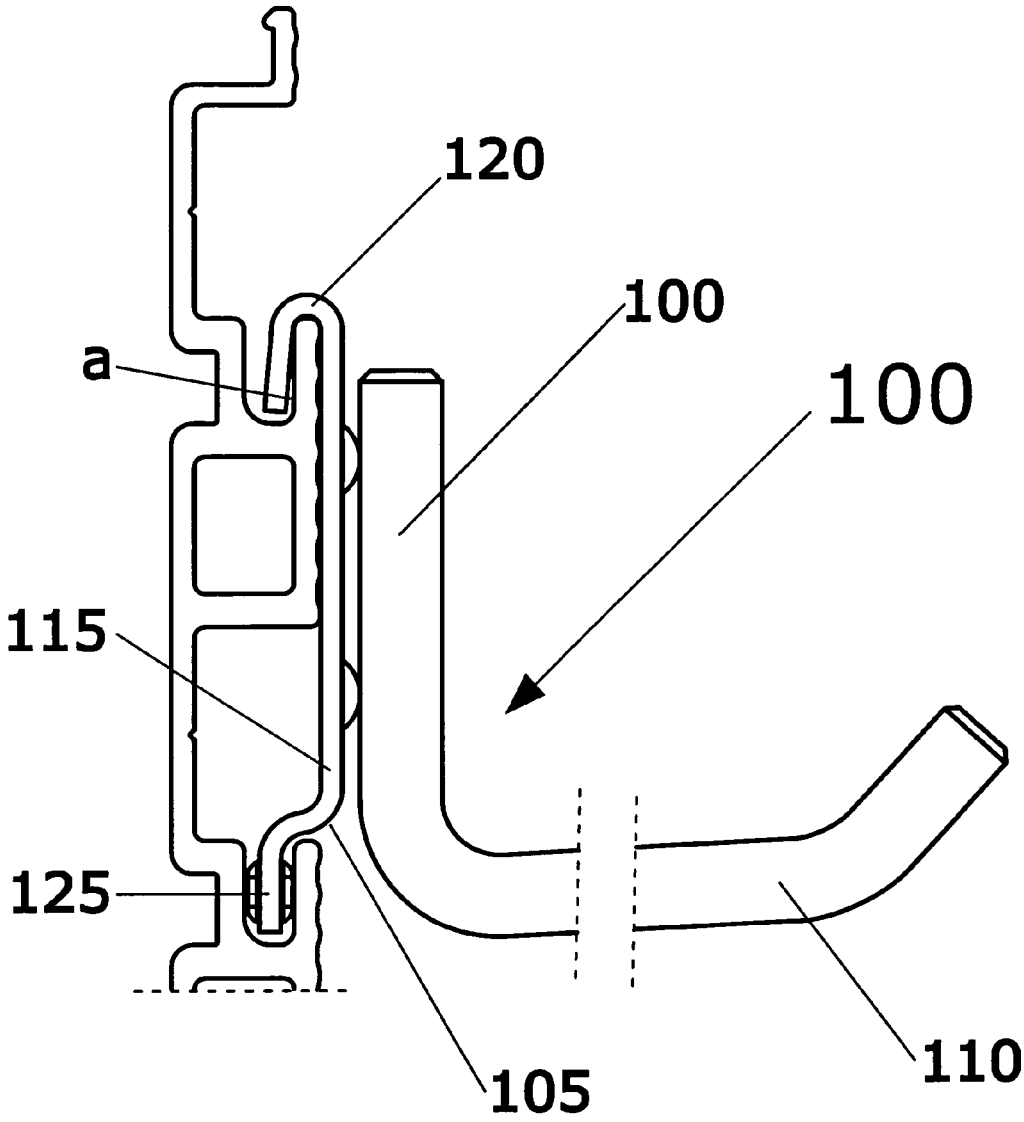
FIG. 3 is an enlarged view of FIG. 2, wherein reference numbers are used to depict the hanger and its components.
Figure 4:
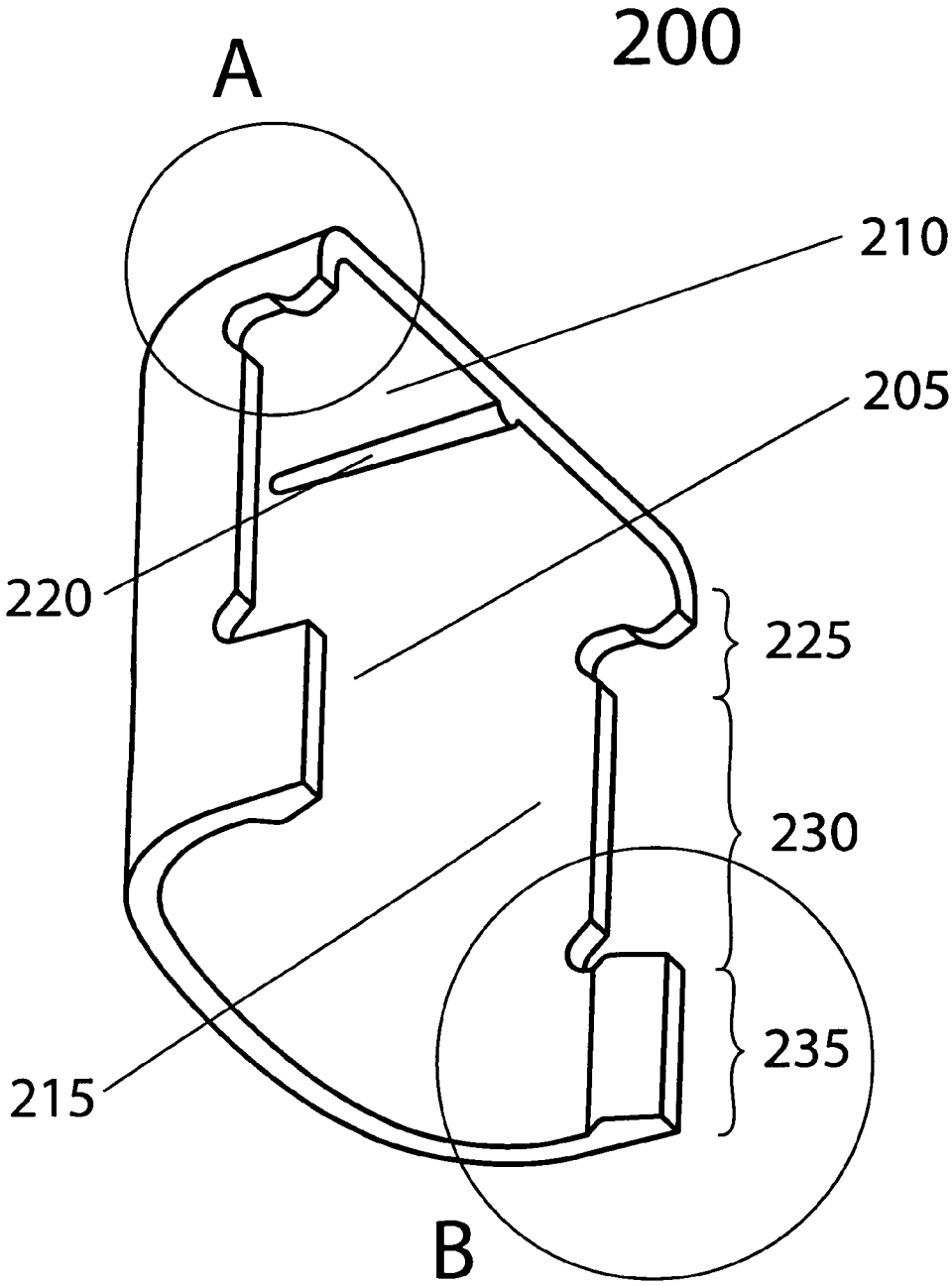
FIG. 4 is a perspective view of the retainer constructed in accordance with the inventive concept of the present invention.
Figure 5:
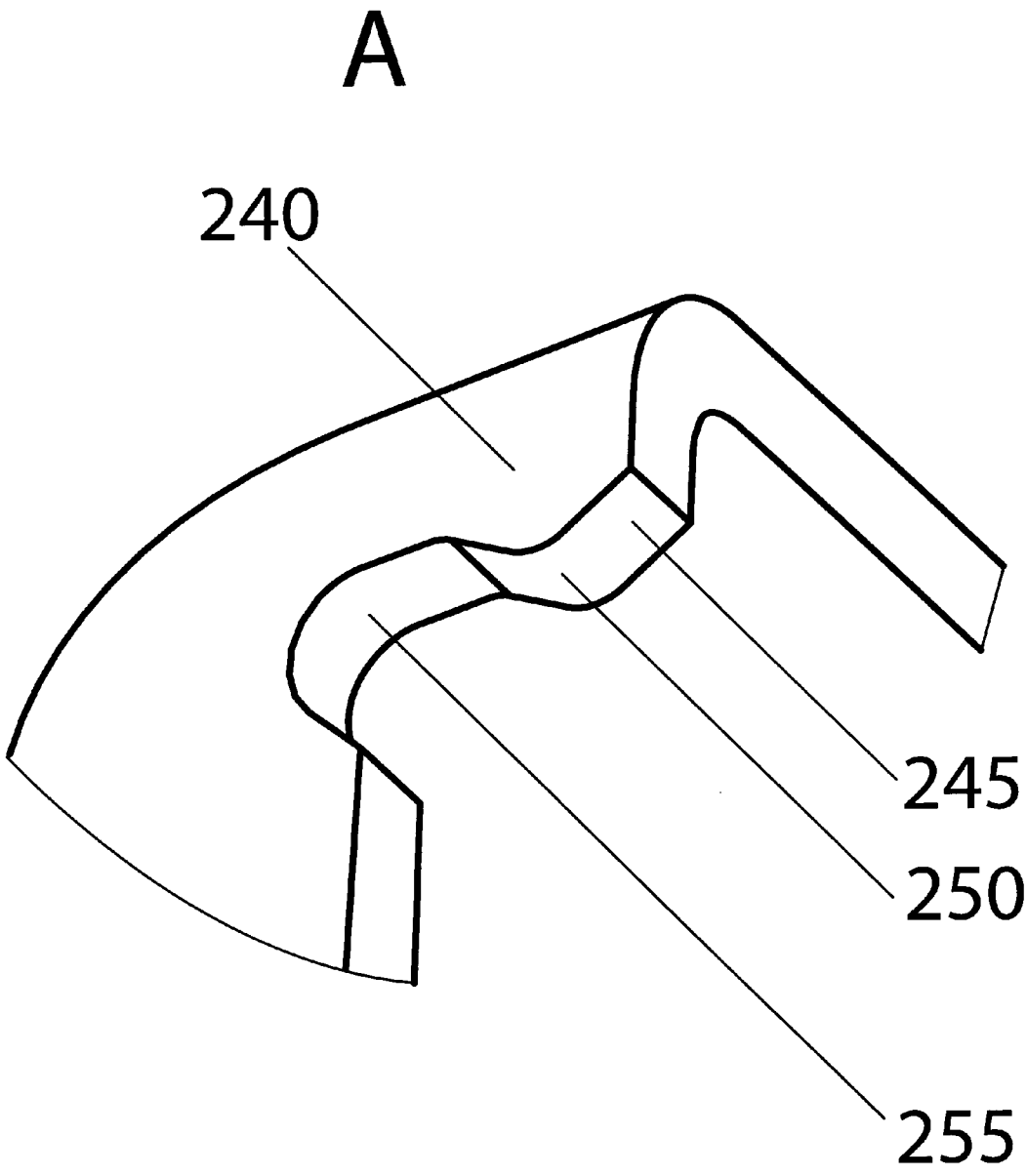
FIG. 5 is an enlarged, fragmentary perspective view A, indicated correspondingly in FIG. 4, and depicting an upper zone of the retainer.
Figure 6:
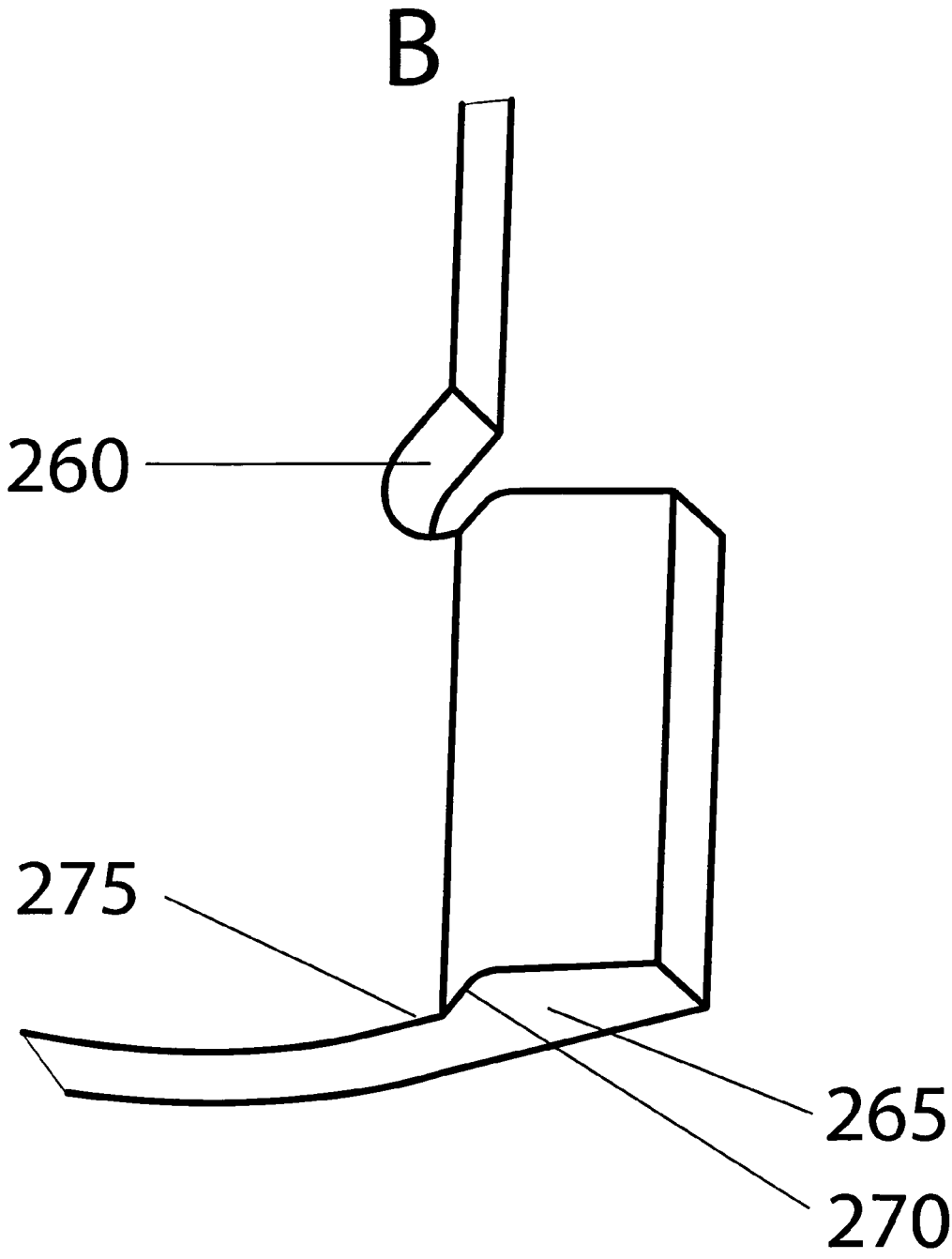
FIG. 6 is an enlarged, fragmentary perspective view B, indicated correspondingly in FIG. 4, and depicting a lower zone of the retainer.

FIGS. 1 to 6 illustrate an embodiment of the present invention, generally designated with numeral 10, which comprises, in combination, a hanger 100 and a retainer 200 that interact and are adapted to be attached to a slatwall track 300.

Slatwall track 300 incorporates several channels 305 extending in parallel along its length. Each of the latter, starting from the top, has a a horizontal top 310, followed downwardly by an upper vertical back 315, a first horizontal bottom 320 extending forwardly, a lower vertical back 325 extending downwardly, and a second horizontal bottom 330 extending forwardly. A frontal vertical wall 335 of slatwall track 300 connects each horizontal top 310 of a lower channel 305 with second horizontal bottom 330 of an upper following channel 305 and continues upwardly as a lip 340. The latter has, in general, a height limited by a plane (not shown) coplanar with an upper surface of first horizontal bottom 320.

Thus, in each channel 305 a niche 345 is formed by lower vertical back 325, lower second horizontal bottom 330 and lip 340.

Although slatwall track 300 is shown and described to have several channels, each of them having a lower lip 340 and a niche 345, it should be understood that other slatwall tracks with differently shaped channels could be used without departing from the broad concept of this invention.

One or more hangers 100 are adapted for use with a slatwall track 300. Usually, each hanger 100 is removably attached to slatwall track 300. Hanger 100 includes a bracket 105 for attaching to slatwall track 300 and one or more hooks 110 permanently secured to bracket 105 and used for suspending different items.

Bracket 105 has a substantially flat body 115, defined by a certain width and extending into an uppermost backwardly folded segment 120 that forms an interstice a adapted to engage and capture partially, in a vertical direction, lip 340 of a channel 305, an upper one, and into a lowermost flat retracted segment 125 that forms a backwardly directed step for engaging a lip 340 of another channel 305, a lower one, namely an inside surface of lip 340. Uppermost folded segment 120 and lowermost flat retracted segment 125 have their vertical dimensions, i.e. their heights, relatively less than a vertical dimension, i.e. a height of lip 340. Thus, a complete engagement of bracket 105 with two vertically spaced lips 340 can be achieved.

Based on the foregoing description, one can infer that, in general, with respect to a slatwall track 300, a hanger 100 is able to keep its vertical position and be horizontally translated.

But in use, when a hanger 100 is unintentionally hit or pushed in a vertical direction, it can easily occur that uppermost, backwardly folded segment 120 ceases to engage and, thus, capture a lip 340 of a channel 305, respectively an upper one; simultaneously lowermost flat retracted segment 125 will exit from niche 345 of another channel 305, respectively a lower one, thereby ceasing the engagement with lip 340 of this channel 305. In this situation, hanger 100, loaded or not, but even more when loaded, will somewhat rotate with respect to frontal vertical wall 335 of slatwall track 300 and fall.

Although hanger 100 is illustrated and described to have a particular structure, it should be understood that other hangers or supporting devices with different structures could be used with the described slatwall 300 or other slatwall tracks without departing from the broad concept of this invention.

Retainer 200 is a monobloc structure, usually made of plastic or other materials, which must be rigid enough to maintain its shape after an insertion into a setting position or removal from the latter; it must be also flexible enough to allow a deformation during insertion and removal. Retainer 200 incorporates a forepart 205 that is followed inwardly and perpendicularly, at its upper end, by a top wall 210 and inwardly, on each side, by a lateral wall 215. Curvilinear surfaces (not shown) are used for transitions between forepart 205 and top and lateral walls 210 and 215, and between top wall 210 and lateral walls 215. Top wall 210 extends backwardly and is adapted to penetrate into an upper channel 305 without reaching upper vertical back 315 of the latter, and incorporates inside, centrally and perpendicularly to forepart 205, a ridge 220 adapted to vertically contact, when in use, uppermost folded segment 120.

Each lateral wall 215 incorporates three zones, respectively an upper 225, middle 230 and lower 235.

Upper zone 225 projects backwardly, coextensively with top wall 210 and incorporates a bottom edge 240 starting with a segment 245; the latter is angled in a vertical plane and adapted for easy engaging a lip 340 of a channel 305, respectively an upper one, when snapping over this lip. Segment 245 is followed towards forepart 205 by an offset protuberance 250 similar to an apex, adapted to engage, when snapped over lip 340, an inside surface of the latter. Segment 245 in combination with offset protuberance 250 form a first snapping subassembly. Offset protuberance 250 is followed by a rounded cut-out 255, carved into a junction of an end of segment upper zone 255 and a top of middle zone 230. Rounded cut-out 255 is open towards the back and bottom of retainer 200 and is intended to facilitate a pivoting of the latter during assembling and also to lodge lip 340, specifically its upper portion when set in place. Another use of cut-out 255 is to reduce stress concentration at the intersection of upper and middle zones, respectively 225 and 230.

Middle zones 230 of lateral walls 215 are retracted with respect to upper and lower zones 225 and 235. Middle zones 230 partially capture bracket 105 by flanking the latter and are in sliding contact with frontal vertical wall 335 of slatwall track 300. Each middle zone 230 terminates, at an intersection with lower zone 235, into a rounded indentation 260 having an opening towards the back of retainer 200. The purpose of rounded indentation 260 is to alleviate stress concentration at that intersection.

Lower zones 235 of lateral walls 215 together with forepart 205 encompass a lower section of bracket 105, before the latter extends into lowermost flat retracted segment 125.

Each lower zone 235 starts from an exterior with a continuously widening section 265 followed by an abruptly thickness reduction portion 270 which ends into a section 275 having a thickness substantially equal with forepart 205, top wall 210 and non specifically described parts of lateral walls 215. Continuously widening section 265 combined with an abruptly thickness reduction portion 270 form a second snapping subassembly.

A distance between rounded cut-out 255, namely its bottom, and an upper edge of lower zone 235 is equal or slightly greater than a distance between an upper edge of a lip 340 of a channel 305, respectively an upper one, and horizontal top 310, respectively its inside surface, of another channel 305, respectively a lower one.

A distance between offset protuberances 250 and upper edges of lower zones 235 is slightly less than a distance between an upper edge of a lip 340 of a channel 305, respectively an upper one, and horizontal top 310, respectively its inside surface, of another channel 305, respectively a lower one.

A distance between opposite lateral walls 215 is equal or slightly greater than a width of bracket 105.

A distance between a continuously widening sections 265, at their maximum, is slightly less than the width of bracket 105.

To secure retainer 200 in a set position to slatwall track 300, the former is so rotated that its upper part is inclined backwardly to penetrate into a channel 305, an upper one, and then capture backwardly folded segment 115 and engage lip 340 with its upper zones 225. By continuing the rotation, a relatively narrow distance between continuously widening sections 270 is forced to increase, following a pressure of retainer 200 against bracket 105; simultaneously a penetration of lower zones 235 into a channel 305, respectively a lower one occurs. Thus, a snapping, resulting from an escaping of continuously widening sections 265 behind bracket 105, takes place.

Basically, the inventive concept of the present invention resides in the fact that the retainer is shaped and sized to accommodate within it a bracket of a hanger in order to prevent an upward, unintentionally caused vertical translation of the bracket, followed by its pivoting and finally fall, by:

using one end of the retainer for positioning and stabilizing, with respect to one channel, one extremity of the bracket, while another end of the retainer, vertically spaced from the aforementioned one, is inserted by snapping into another parallel channel.

As required, a detailed embodiment of the present invention is disclosed herein; however, it is to be understood that the disclosed embodiment is merely exemplary of the invention which may be embodied in various forms. Therefore, specific structural and functional details disclosed herein are not to be interpreted as limiting, but merely as a basis for the claims and as representative basis for teaching one skilled in the art to variously employ the present invention in virtually any appropriately detailed structure.

What is claimed is:

1. A retainer adapted for use in a combination with a hanger for securing to a slatwall track, said slatwall track including several parallel channels extending along its length, each of said several parallel channels incorporating a horizontal top, successively followed downwardly by an upper vertical back, a first horizontal bottom extending forwardly, a lower vertical back extending downwardly and a second horizontal bottom extending forwardly, and then a frontal vertical wall of said slatwall track connecting each said horizontal top of a lower channel with said second horizontal bottom of an upper following channel continues upwardly as a lip, a niche being formed by said lower vertical back, said lower second horizontal bottom and said lip;

said hanger, being adaptable to be removably attachable to said slatwall track, comprising a bracket for suspending to said slatwall track, one or more hooks being secured to said bracket;

said bracket having a substantially flat body extending into an uppermost backwardly folded segment forming an interstice adapted for engaging and partially capture, in a vertical direction, in said lip of said upper channel; and into a lowermost flat retracted segment adapted to penetrate into said niche and engage an inside surface of said lip of said lower channel;

said retainer having a unitary structure that must be rigid enough for maintaining its shape after an insertion into a setting position or removal from said setting position; and must also be flexible enough to allow a deformation during its insertion and removal, said retainer incorporating a forepart that is followed inwardly and perpendicularly, at its upper end, by a top wall and inwardly, on each side by a lateral wall, said top wall extending backwardly and being adapted to penetrate into one of said channels without abutting said upper vertical back, each of said lateral walls incorporating three zones, respectively an upper, middle and a lower one, said upper zone projecting backwardly, coextensively with said top wall and incorporating a bottom edge comprising a first means for snapping adapted for easy engaging said lip, namely an inside surface of an upper channel, said first means for snapping being followed by a rounded cut-out, carved into a junction of an end of said first means for snapping and a top of said middle zone, said rounded cut-out being open towards the back and bottom of said retainer and is adapted to facilitate a pivoting of said retainer during assembling and also to lodge said lip, specifically its upper portion when set in place; said middle zones of said lateral walls being retracted with respect to said upper and lower zones, said middle zones partially capturing said bracket by flanking it and adapted to be in sliding contact with said frontal vertical wall of said slatwall track, each said middle zone terminating, at an intersection with said lower zone, into a rounded indentation having an opening towards the back of said retainer, said lower zones of said lateral walls together with said forepart encompassing a lower section of said bracket, before said lower section of said bracket terminating into said lowermost flat retracted segment;

each said lower zone, starting from its exterior, being provided with a second means for snapping followed by a section having a thickness substantially equal with said forepart and said top wall;

a distance between the bottom of said rounded cut-out and an upper edge of said lower zone being equal or slightly greater than a distance between an upper edge of said lip of said channel, respectively an upper one, and said horizontal top, respectively its inside surface, of another channel, respectively a lower one; whereby a distance between said first means for snapping, a most outwardly projecting part of said first means for snapping, and said upper edges of said lower zones being slightly less than a distance between an upper edge of said lip of said channel, respectively an upper one, and said horizontal top, respectively its inside surface, of another channel, respectively a lower one; and a distance between said sections of said opposite lateral walls being equal or slightly greater than a width of said bracket; and a distance between continuously widening sections of said lower zone at their maximum, being slightly less than said width of said bracket, whereby to secure said retainer in a set position to said slatwall track, said retainer is so rotated that its upper part is inclined backwardly to penetrate into one of said channels, respectively an upper one, and then capture said backwardly folded segment and engage said lip with its upper zones and by continuing the rotation a relatively narrow distance between said second means for snapping is forced to increase following the pressure of said retainer against said bracket;

simultaneously a penetration of said lower zones into one of said channels, respectively a lower one, thus, a snapping, resulting from an escaping of said second means for snapping behind said bracket, takes place; and whereby said retainer being shaped and sized to accommodate within it said bracket of said hanger in order to prevent an upward, vertical translation of said bracket, followed by its pivoting and finally fall, by:

using one end of said retainer for positioning and stabilizing, with respect to one of said channel, an upper one, one extremity of said bracket, while another end of sad retainer, vertically spaced from said one end of said retainer, being inserted by snapping into another parallel channel.

* * * * *